US011185464B2

(12) United States Patent
Kim et al.

(10) Patent No.: US 11,185,464 B2
(45) Date of Patent: Nov. 30, 2021

(54) CONSTIPATION TREATMENT APPARATUS USING WARM AND AIR CELLS

(71) Applicant: BMS CO., LTD, Paju-si (KR)

(72) Inventors: Tae Young Kim, Cheongju-si (KR); Sin Il Moon, Goyang-si (KR)

(73) Assignee: BMS CO., LTD, Paju-si (KR)

( * ) Notice: Subject to any disclaimer, the term of this patent is extended or adjusted under 35 U.S.C. 154(b) by 316 days.

(21) Appl. No.: 16/200,746

(22) Filed: Nov. 27, 2018

(65) Prior Publication Data

US 2020/0163823 A1 May 28, 2020

(51) Int. Cl.
*A61H 9/00* (2006.01)

(52) U.S. Cl.
CPC ... *A61H 9/0078* (2013.01); *A61H 2201/0207* (2013.01); *A61H 2201/1238* (2013.01); *A61H 2201/165* (2013.01)

(58) Field of Classification Search
CPC ..... A61H 9/00; A61H 9/005; A61H 9/0078; A61H 9/0092; A61H 1/00; A61H 2201/1238; A61H 2201/165; A61H 2201/0207; A61H 2201/0173
See application file for complete search history.

(56) References Cited

U.S. PATENT DOCUMENTS 6,196,990 B1 * 3/2001 Zicherman ..... A61M 1/282 604/29
6,361,512 B1 * 3/2002 Mackay ..... A61H 9/0078 601/149
2004/0260216 A1 * 12/2004 Zicherman ..... A61H 23/0254 601/111
2007/0129658 A1 * 6/2007 Hampson ..... A61H 9/0078 602/13
2016/0213553 A1 * 7/2016 Oberg ..... B60N 2/976
2016/0361224 A1 * 12/2016 Ramakrishna ..... A61H 9/0078
2018/0193220 A1 * 7/2018 Benet Pozo ..... A61H 7/007

* cited by examiner

*Primary Examiner* — Colin W Stuart
*Assistant Examiner* — Douglas Y Sul
(74) *Attorney, Agent, or Firm* — Lex IP Meister, PLLC

(57) ABSTRACT

A constipation treatment apparatus includes an air supplying motor installed at an internal space of a curved frame to supply air generated from a supply pipe to the air cell and a heat/massage module group including a lower right heat/massage module, a right heat/massage module, a central heat/massage module, a lower left heat/massage module, and a left heat/massage module, each of the heat/massage modules including the air cell and a heat generation module. The air cell has a dual structure including an upper air cell and a lower air cell.

5 Claims, 8 Drawing Sheets

CONSTIPATION TREATMENT APPARATUS USING WARM AND AIR CELLS

BACKGROUND OF THE INVENTION

Field of the Invention

The present invention relates to a constipation apparatus using warm and air cells, and more particularly to a constipation apparatus using warm and air cells for providing a circulation control structure matching with bowel movement and a structure suited to a skeleton structure of a body.

Description of the Related Art

Constipation is generally digestive symptom to appeal. 20% is increased in the western and the constipation is gradually increased in Korea so that prevalence of 16.5% is reported and the constipation is further increased in women, children, and old men.

Constipation surprisingly causes a serious influence on the everyday life to apply misery beyond a degree of discomforting the everyday life and to cause a serious result such as wrong abuse and side effect of medicine.

The constipation is generated from endocrine disease, metabolic disease, neurological disease or organic disease such as colorectal cancer but mostly appears as a functional constipation without knowing a reason so that it is difficult to cure the constipation. Further, symptoms related to the constipation are intermittent and weak in most cases but are difficult to chronically and continuously cure the above symptoms.

The constipation is a very common chronic disease where improvement and aggravation of a symptom are repeated to deteriorate the quality of the life and to reduce medical treatment and physical metal function so that socioeconomic loss is caused. Accordingly, the suitable development of cure guideline of constipation is to develop a device capable of easily giving efficient help to constipation cure in everyday life because it is determined that socioeconomic benefit is high due to an efficient use of a current limited medical treatment resource and improvement of patients.

Today, a treatment device provided as a stomach massage device for constipation cure mainly includes only a massage device by a mechanical device. A massage device using warm and air cells is rarely used.

The massage device using warm and air cells may perform a massage function by fully injecting and exhausting air instead of separately operating an air cell.

Accordingly, since a bowel performs peristalsis in a case of stomach, if a massage is wrong performed, foods and the like rather backflow so that the massage device using warm and air cells is not suitable for a stomach massage device.

Therefore, a corresponding technical field uses warm and air cells. There is a need to develop a technology for solving a problem which cannot adjust pressed pressure to perform massage by an existing mechanic device and not to backflow foods associated with peristalsis of a bowel.

SUMMARY OF THE INVENTION

The present invention has been made in view of the above problems, and provides a constipation apparatus using warm and air cells for providing stomach massage by a complementary therapy for reducing chronic constipation together with heat and preventing foods inside a stomach (stomach twist) due to excessive pressure from back-flowing by using an air cell.

The present invention further provides a constipation apparatus using warm and air cells for improving constipation symptom by reinforcing stomach muscle, exalting peristalsis of stomach, reducing pass time of stomach, and increasing regularity of a bowel and bowel movement.

The present invention further provides a constipation apparatus using warm and air cells being non-invasive for preventing side effect harmful in a body using a stomach massage device and performing by a patient by a simple method.

The above information disclosed in this background section is only for enhancement of understanding of the background of the invention and therefore it may contain information that does not form the prior art that is already known in this country to a person of ordinary skill in the art.

In accordance with an aspect of the present disclosure, a constipation treatment apparatus using warm and air cells, the apparatus including: a air supplying motor 140 installed at an internal space of a curved frame 110 to supply air generated from a supply pipe 1 to the air cell; a heat/massage module group 150*a* to 150*e* including a lower right heat/massage module 150*a*, a right heat/massage module 150*b*, a central heat/massage module 150*c*, a lower left warm/massage module 105*d*, and a left heat/massage module 150*e*, each of heat/massage modules 150*a* to 150*e* including an air cell and a heat generation module 150-3; and a control unit 180 configured to control the heat generation module 150-3 and the air cell in each heat/massage modules 150*a* to 150*e* independently.

The constipation treatment apparatus using warm and air cells may further include a solenoid valve group 170*a* to 170*e* configured by a solenoid valve 170 installed at a supply pipe 1 at an internal space of the curved frame 110 of the constipation treatment apparatus using warm and air cells.

The solenoid valve group 170*a* to 170*e* may perform air injection and exhaustion with respect to the air cell of at least one heat/massage module of the heat/massage module group 150*a* to 150*e*.

The solenoid valve group 170*a* to 170*e* may include a lower solenoid valve 170*a*, a right solenoid valve 170*b*, a central solenoid valve 170*c*, a lower left solenoid valve 170*d*, and a left solenoid valve 170*e*.

The air cells 150-1 and 150-2 may be overlapped with an upper portion of the heat generation module 150-3 making contact with a body.

The heat generation module 150-3 internally makes contact with a body skin.

The air cell may be configured by a dual structure including an upper air cell 150-1 and a lower air cell 150-2.

A diameter of an air supply port of the lower air cell 150-2 may be greater than a diameter of an air supply port of the upper air cell 150-1, the supply pipe 1 is connected to the lower air cell 150-2, The upper air cell 150-1 and the lower air cell 150-2 may include thermo-plastic polyurethane (TPU).

In the present invention, divided parts (five pieces) of the upper air cell 150-1 and the lower air cell 150-2 and the heat generation module 150-3 include one upper piece corresponding to the central heat/massage module 150*c*, lower two pieces corresponding to the lower right heat/massage module 150*a* and a lower left heat/massage module 150*d*, a left piece corresponding to a left heat/massage module 150, and a right piece corresponding to a right heat/massage module 150*d*.

Further, in the present invention, a valve for injecting air into a lower air cell 150-2 of the heat/massage module group 150*a* to 150*e* uses a solenoid valve, and the control unit 180 controls the solenoid valve 170 and the air supplying motor 140 so that air is sequentially injected into respective air cells 150-1 and 150-2 from the air supplying motor 140.

A constipation apparatus using warm and air cells according to an embodiment of the present invention may provide stomach massage by a complementary therapy for reducing chronic constipation together with heat and preventing foods inside a stomach (stomach twist) due to excessive pressure from back-flowing by using an air cell.

A constipation apparatus using warm and air cells according to another embodiment of the present invention may improve constipation symptom by reinforcing stomach muscle, exalting peristalsis of stomach, reducing pass time of stomach, and increasing regularity of a bowel and bowel movement.

A constipation apparatus using warm and air cells according to another embodiment of the present invention may further provide a constipation apparatus using warm and air cells being non-invasive for preventing side effect harmful in a body using a stomach massage device and performing by a patient by a simple method.

BRIEF DESCRIPTION OF THE DRAWINGS

The objects, features and advantages of the present disclosure will be more apparent from the following detailed description in conjunction with the accompanying drawings, in which.

DETAILED DESCRIPTION OF EXEMPLARY EMBODIMENTS

Figure 1:
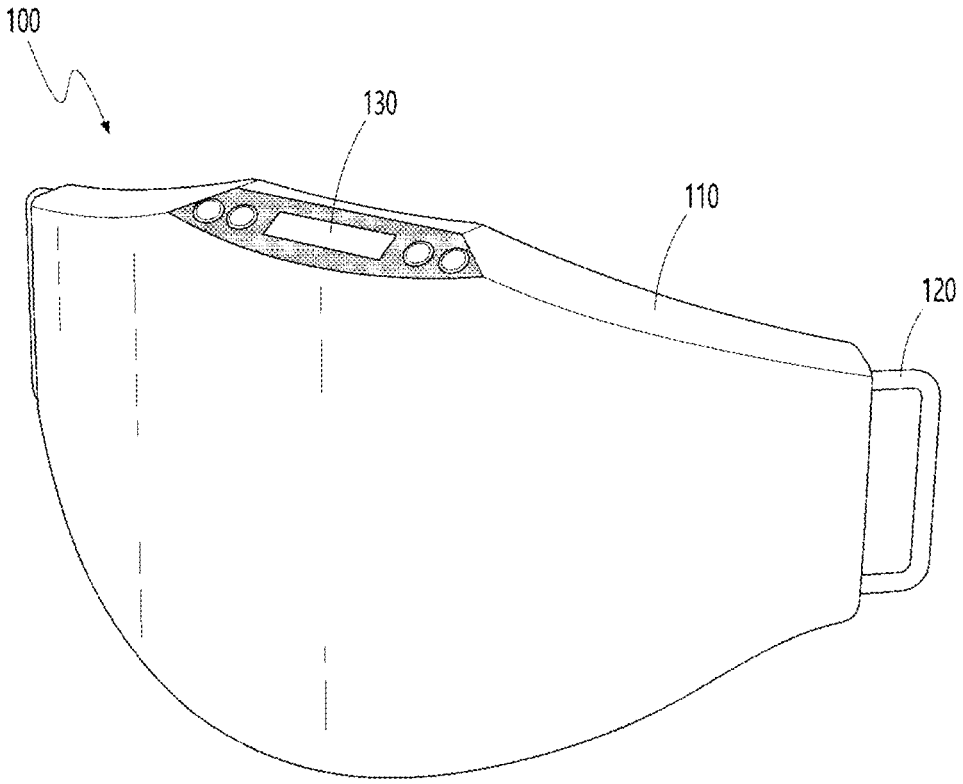
FIG. 1 is a perspective view illustrating a constipation apparatus 100 using warm and air cells according to an embodiment of the present invention.
Figure 2A:
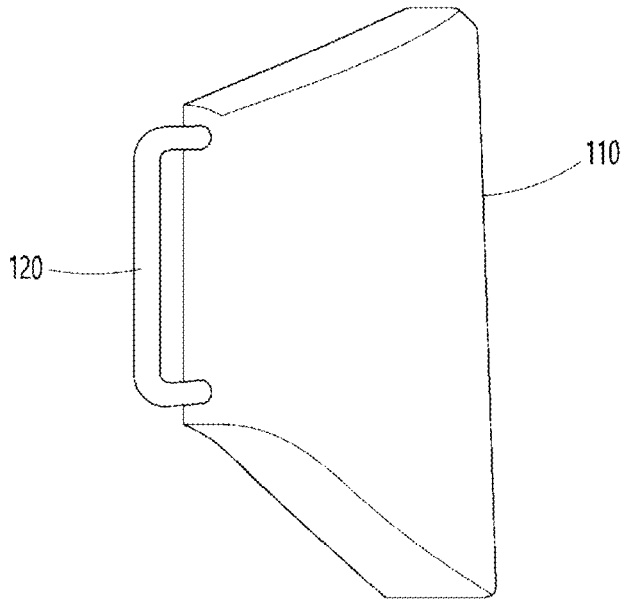
FIG. 2*a* is a left side view illustrating a constipation apparatus 100 using warm and air cells and FIG. 2*b* is a view illustrating an input device 130 according to an embodiment of the present invention.
Figure 2B:
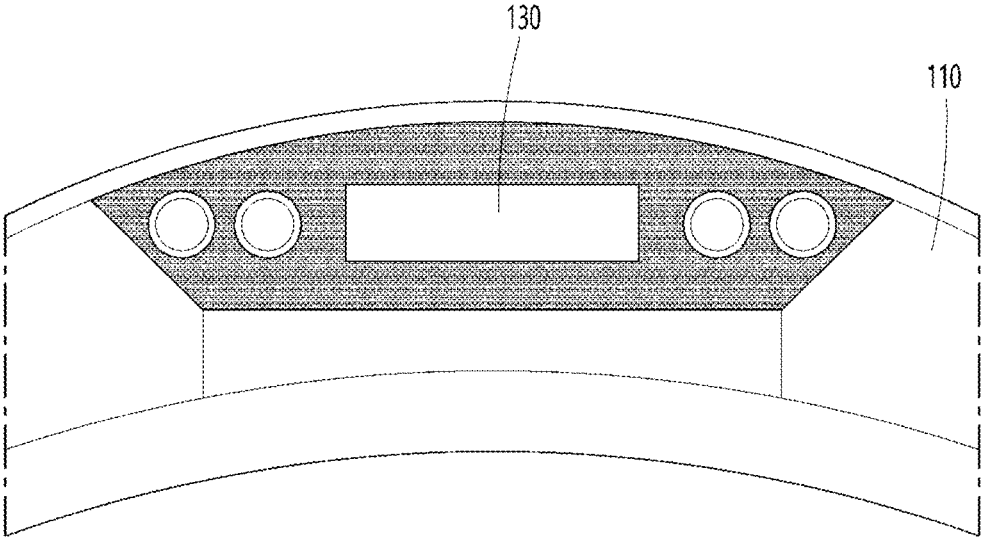
Figure 3A:
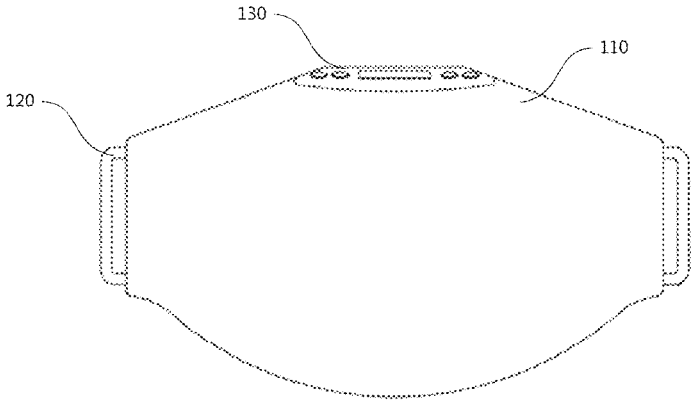
FIG. 3*a* is a front view and FIG. 3*b* is a left side view illustrating a constipation apparatus 100 using warm and air cells according to an embodiment of the present invention.
Figure 3B:
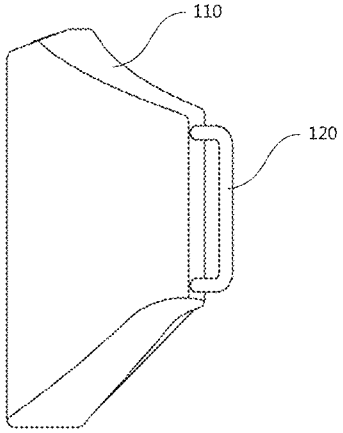

The details of other embodiments are contained in the detailed description and accompanying drawings. In the following description, if detailed description about well-known functions or configurations may make the subject matter of the disclosure unclear, the detailed description.

In the specification, a case where one constituent element transmits data or a signal to another constituent element means a case where a constituent element may directly transmit the data or the signal to another constituent element and may transmit the data or the signal through at least one other constituent element.

Referring to FIG. 1 to FIG. 8, the constipation apparatus 100 using warm and air cells according to an embodiment of the present invention may include a curved frame 110, a belt attachment stage 120, an input device 130, an air supplying motor 140, a heat/massage module group 150*a* to 150*e*, a charging unit 160 configured by a charging battery, a solenoid valve group 170*a* to 170*e*, and a control unit 180.

The air supplying motor 140 is installed an internal space of the curved frame 110 of the constipation apparatus 100 and supplies air created through a supply pipe 1 to an air cell.

Each solenoid valve 170 configuring the solenoid valve group 170*a* to 170*e* is installed at a supply pipe 1 in the internal space of the curved frame 110 of the constipation apparatus 100 and may control a flow of air.

Here, the heat/module group may include a lower right heat/massage module 150*a*, a right heat/massage module 150*b*, a central heat/massage module 150*c*, a lower left heat/massage module 150*d*, and a left heat/massage module 150*e*.

Further, each heat/massage module 150*a* to 150*e* may include an upper air cell 150-1, a lower air cell 150-2, and a heat generation module 150-3.

The solenoid valve group may include a lower right solenoid valve 170*a*, a right solenoid valve 170*b*, a central solenoid valve 170*c*, a lower left solenoid valve 170*d*, and a left solenoid valve 170*e*.

Moreover, each solenoid valve 170*a* to 170*e* may include a solenoid valve 170.

Figure 4:
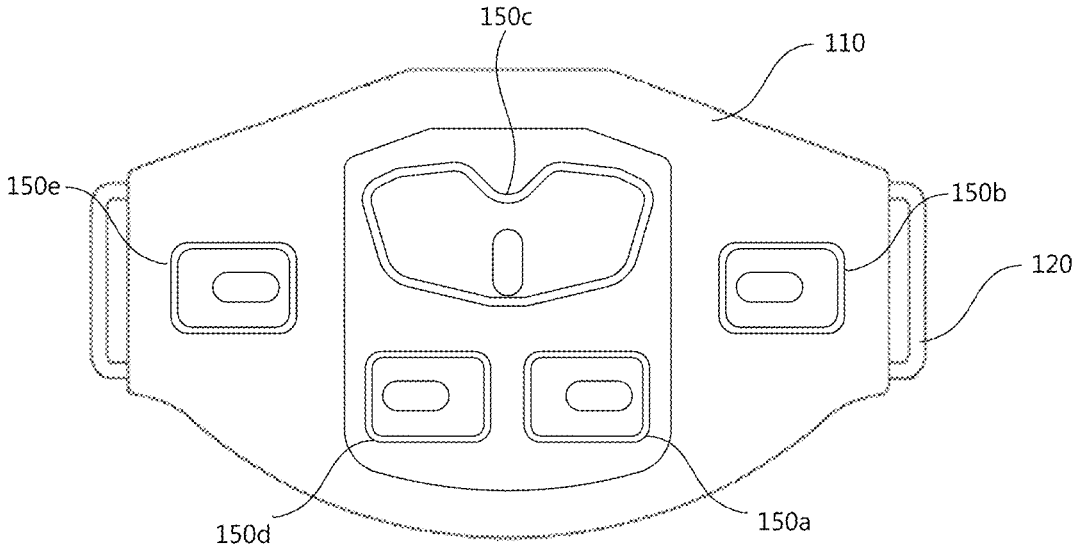
FIG. 4 is a view a constipation apparatus 100 using warm and air cells according to an embodiment of the present invention.

That is, as shown in FIG. 4, the constipation apparatus 100 using warm and air cells may include heat/massage modules 150*a* to 150*e* divided into five parts and may include a heat generation module 150-3 and air cells 150-1 and 150-2 installed in each divided part.

Figure 5:
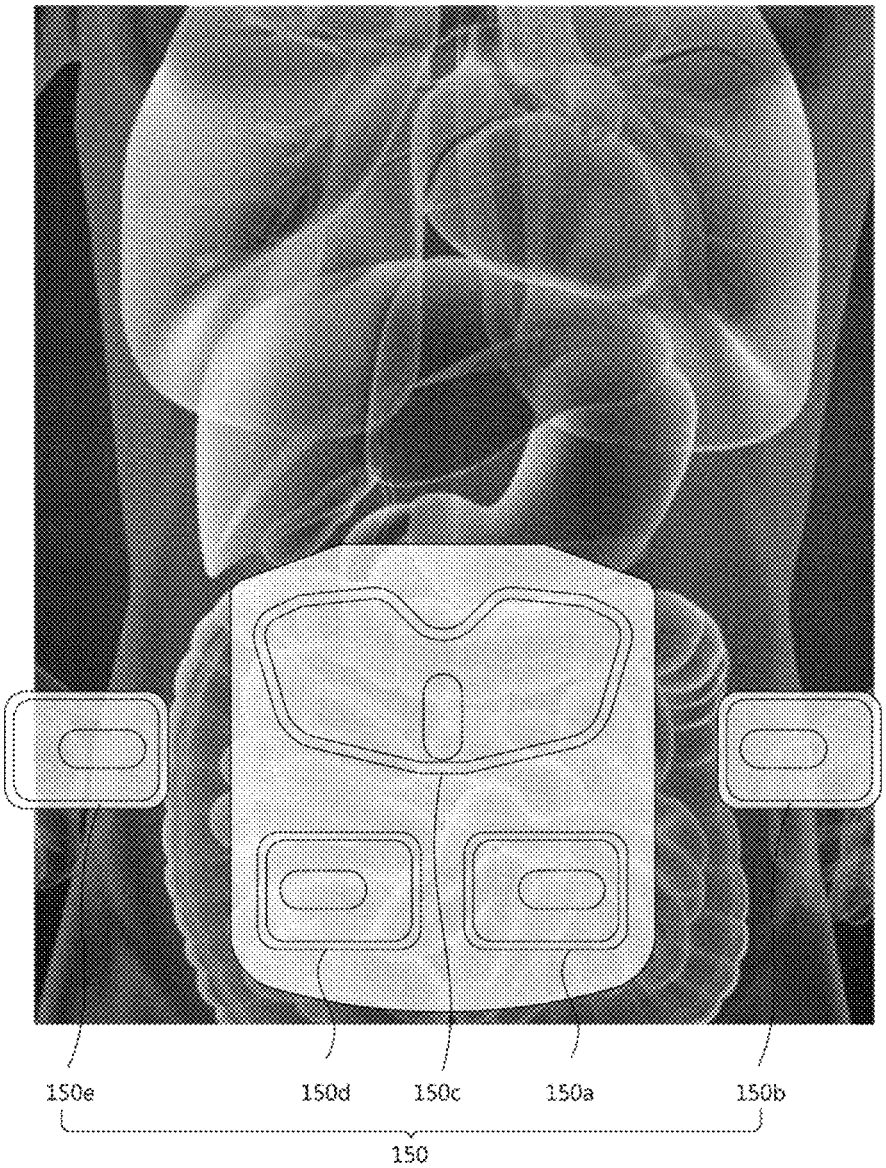
FIG. 5 is a diagram illustrating a massage scheme according to arrangement of heat/massage module group 150*a* to 150*e* in a constipation apparatus 100 using warm and air cells according to an embodiment of the present invention.

The reason to configure the above that a phenomenon such as stiffness may occur due to skeleton when the above is matched with bowel movement as shown in FIG. 5 and it is wrongly arranged by taking into consideration a skeleton structure of a person.

Figure 6A:
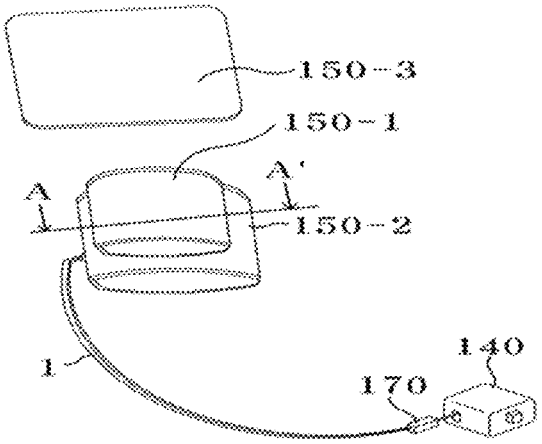
FIGS. 6*a* and 6*b* are diagrams illustrating structures of an upper air cell 150-1 and a lower air cell 150-2 configuring each heat/massage module of heat/massage module group 150*a* to 150*e* in a constipation apparatus 100 using warm and air cells according to an embodiment of the present invention.
Figure 6B:
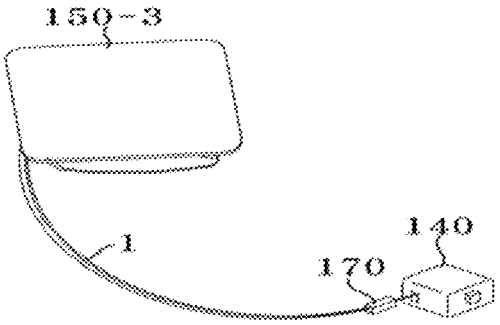

As shown in FIG. 6, in the heat generation module 150-3 and the air cells 150-1 and 150-2, since the air cells 150-1 and 150-2 are overlapped with each other as an upper portion of the heat generation module 150-3 making contact with a body, the heat generation module 150-3 is arranged to make contact with an inner side, that is, a body skin.

The heat generation module 150-3 is arranged to make contact with an inner side, that is, a body skin so that bowel may be further pressed by expansion pressure upon expansion of the air cells 150-1 and 150-2 under control of a control unit 180 for the air cells 150-1 and 150-2.

As shown in FIG. 6, the air cells 150-1 and 150-2 have a dual structure and include an upper air cell 150-1 and a lower the air cell 150-2. The reason to form the dual structure is that the dual structure may easily compress and expand the air cells and may deeply a body skin.

That is, if the size (area) of the air cell is increased, a billowed degree is increased so that a billowed height is increased. However, it is difficult to be divided and used the air cell so that the air cell cannot massage according to bowel movement. When the air cells are divided and used in a small size, a pressed height is reduced so that there is no massage effect. Accordingly, the air cells are divided into the upper air cell 150-1 and the lower air cell 150-2 in a small size and have a dual structure in order to represent massage effects.

Figure 7:
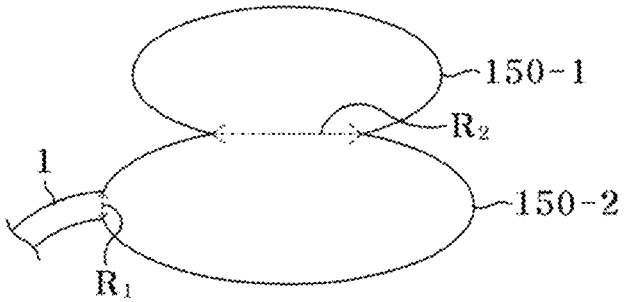
FIG. 7 is a sectional view taken along line A-A' of FIG. 6*a*.
Figure 8:
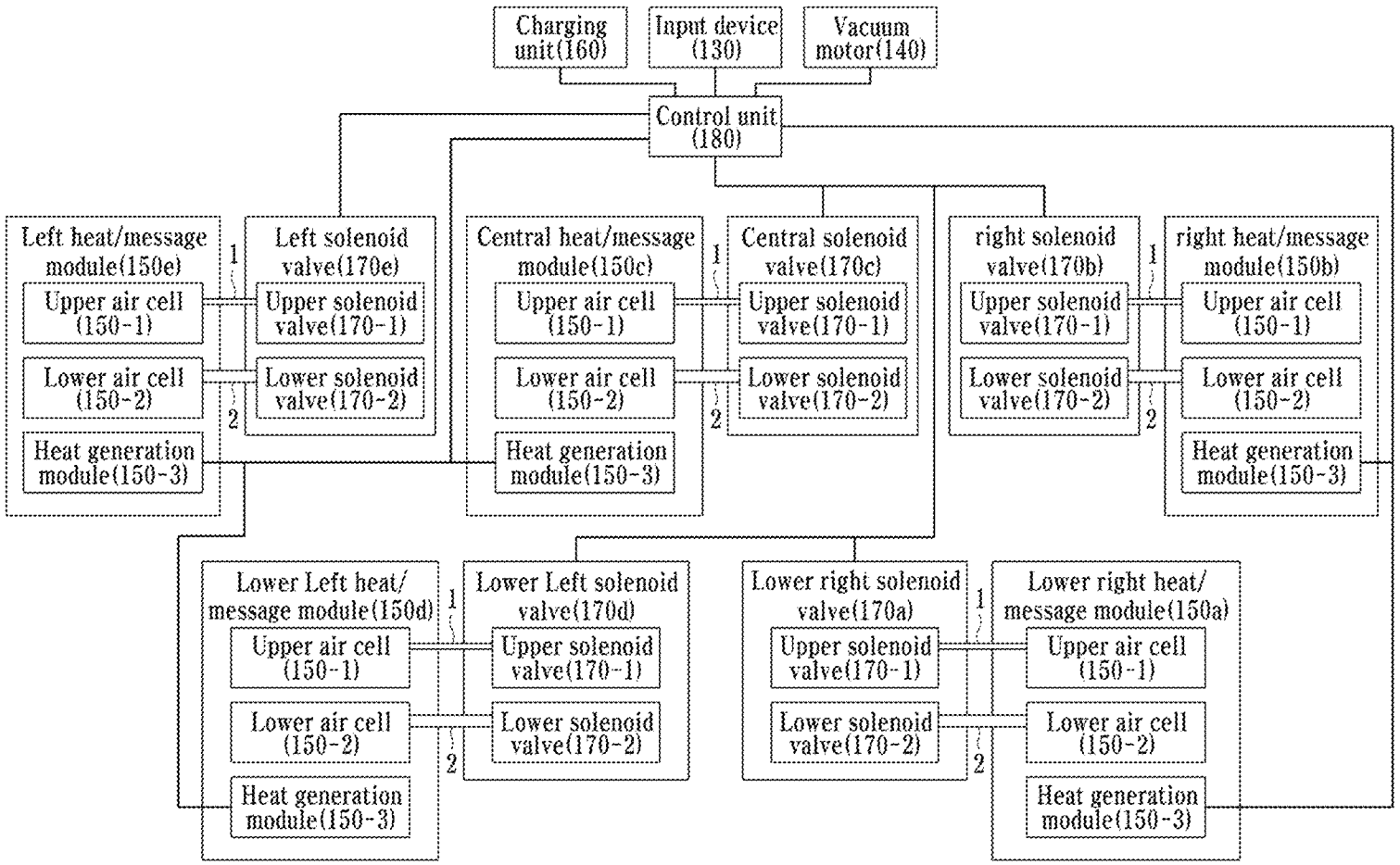
FIG. 8 is a block diagram illustrating respective constituent elements of a constipation apparatus 100 using warm and air cells according to an embodiment of the present invention.

In this case, as shown in FIG. 6 and FIG. 7, if a diameter R1 of an air supply port of the lower air cell 15-2 is greater than a diameter R2 of an air supply port of the upper air cell 15-1, an internal volume of the lower air cell 15-2 is greater than an internal volume of the upper air cell 15-1. Accordingly, compression and expansion are easy while matching air pressure with balance. Further, air is sequentially supplied into the upper air cell 15-1 through the lower air cell 15-2 to efficiently stimulate a stomach located in a deep position of a body.

Meanwhile, the upper air cell 150-1 and the lower air cell 150-2 include thermo plastic polyurethane (TPU), and may have easy compression and expansion, and may have durability capable of withstanding pressure.

In the meantime, a reason why the present invention uses the air cells 150-1 and 150-2 is because it is difficult to adjust intensity of a cam of an existing massage device if the cam massages bowel and additional pressure is not generated if the cam makes contact with a bone part. Accordingly, the present invention applies a method of using air pressure.

As shown in FIG. 4 and FIG. 5, divided parts (five pieces) of the air cells 150-1 and 150-2 and the heat generation module 150-3 include one upper piece corresponding to the central heat/massage module 150*c*, lower two pieces corresponding to the lower right heat/massage module 150*a* and a lower left heat/massage module 150*d*, a left piece corresponding to a left heat/massage module 150*e*, and a right piece corresponding to a right heat/massage module 150*d*.

For this reason, an upper region of the central heat/massage module 150*c* is connected to bowel so that one piece may massage. The reason why the above is configured according to bowel movement because a lower area corresponding to the lower right heat/massage module 150*a*, the right heat/massage module 150*b*, the lower left heat/massage module 150*d*, and the left heat/massage module 150*e* is not connected to the bowel. Furthermore, it is preferred that the right heat/massage module 150*b* and the left heat/massage module 150*e* corresponding to right and left pieces are positioned suited to a body skeleton.

In addition, a valve for injecting air into respective air cells 150-1 and 150-2 of the heat/massage module group 150*a* to 150*e* may use a solenoid valve 170 so that the control unit 180 may control each solenoid valve 170 and the air supplying motor 140 to inject air into the lower air cell 150-2 from the air supplying motor 140.

An operation method of the air cells 150-1 and 150-2 formed at the lower right heat/massage module 150*a*, the right heat/massage module 150*b*, the central heat/massage module 150*c*, the lower left heat/massage module 150*d*, and the left heat/massage module 150*e* configuring the heat/massage module group 150*a* to 150*e* by the control unit 180 will be described as follows.

The control unit 180 injects air into the upper and lower air cells 150-1, 150-2 by injecting air into the lower air cell 150-2 according to valve ON control with respect to the lower right solenoid valve 170*a* to inject air provided to the upper and lower air cells 150-1 and 150-2 included in the lower right heat/massage module 150*a* and the right heat/massage module 150*b* from the air supplying motor 140.

Next, the control unit 180 removes air inside the upper and lower air cells 150-1 and 150-2 of the lower right heat/massage module 150*a* according to valve OFF control with respect to the lower right solenoid valve 170*a*, and injects air into the upper and lower air cells of the central heat/massage module 150*c* corresponding to an upper air cell while maintaining air pressure in the upper and lower air cells 150-1 and 150-2 included in the right heat/massage module 150*b* so that the air is injected at a right side and an upper portion of the bowel.

Next, the control unit 180 removes air according to valve OFF control with respect to the right solenoid valve 170*b* to remove air with respect to the upper and lower air cells 150-1 and 150-2 included in the right heat/massage module 150*b* corresponding to a right air cell, controls the solenoid valve 170 configuring the left solenoid valve 170*e* by valve ON to inject air into the upper and lower air cells 150-1 and 150-2 included in the left heat/massage module 150*e* corresponding to a left air cell, so that air pressure is maintained at an upper portion and a left side of the bowel.

Finally, the control unit 180 valve OFF controls the solenoid valve 170 corresponding to the central solenoid valve 170*c* to remove air injected in the upper and lower air cells 150-1 and 150-2 included in the central heat/massage module 150*c* corresponding to an upper cell, and valve ON controls the solenoid valve 170 corresponding to the lower left solenoid valve 170*d* to inject air into the upper and lower air cells 150-1 and 150-2 included in the lower left heat/massage module 150*d* corresponding to a lower left air cell while maintaining the air in the upper and lower air cells 150-1 and 150-2 of the left heat/massage module 150*e* corresponding to a left air cell, so that air is injected.

Accordingly, air pressure is injected such as stomach movement clockwise to maintain air in two adjacent air cells similar to the movement direction of stomach. Otherwise, food inside the stomach (stomach twist) may back-flow.

Further, in an embodiment of the present invention, the heat generation module 150-3 formed at each heat is PCB heating element, when air is injected inside the upper and lower air cells 150-1 and 150-2 included in respective heat/massage module 150*a* to 150*e* under control of the control unit 180, the heat generation module 150-3 generates heat under the control of the control unit 180. Since the air is injected inside the upper and lower air cells 150-1 and 150-2 included in respective heat/massage module 150*a* to 150*e* by an air supplying motor 140 as described above, the air generated by the air supplying motor 140 is repeatedly injected and exhausted inside the upper and lower air cells 150-1 and 150-2 included in the respective heat/massage module 150*a* to 150*e* so that the bowel may be activated and the constipation may be cured.

In the present invention, it is preferred that the control unit 180 provides a function of a safety device to force stop once after 15 minutes, and further includes a temperature sensing function so that a heat generation temperature of the heat generation module 150-3 does not exceed a maximum 80° C.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A constipation treatment apparatus using warm and air cells, the apparatus comprising:

an air supplying motor installed at an internal space of a curved frame to supply air generated from a supply pipe to the air cells;

a heat/massage module group including a lower right heat/massage module, a right heat/massage module, a central heat/massage module, a lower left heat/massage module, and a left heat/massage module, each of the heat/massage modules including one of the air cells and a heat generation module; and a control unit configured to control the heat generation module and the air cells in each of the heat/massage modules, wherein the air cells are configured by a dual structure including an upper air cell and a lower air cell, a diameter of an air supply port of the lower air cell is greater than a diameter of an air supply port of the upper air cell, and the supply pipe is connected to the lower air cell, the air supplied from the air supplying motor is supplied to the air supply port of the upper air cell through the supply pipe and the air supply port of the upper air cell so that the air is sequentially injected into the upper air cell, wherein the lower right heat/massage module and the lower left heat/massage module are symmetrically disposed under the central heat/massage module to form a triangularly arranged module set along with the central heat/massage module, and the triangularly arranged module set is disposed between the right heat/massage module and the left heat/massage module, wherein the central heat/massage module is configured to be positioned on bowel, and wherein the right heat/massage module and the left heat/massage module are configured to be positioned on a body skeleton.

2. The constipation treatment apparatus using warm and air cells of claim 1, further comprising a solenoid valve group configured by a solenoid valve installed at the supply pipe at an internal space of the curved frame of the constipation treatment apparatus.

3. The constipation treatment apparatus using warm and air cells of claim 2, wherein the solenoid valve group performs air injection and exhaustion with respect to the air cells of at least one heat/massage module of the heat/massage module group.

4. The constipation treatment apparatus using warm and air cells of claim 1, wherein the air cells are overlapped with an upper portion of the heat generation module which is configured to contact a body.

5. The constipation treatment apparatus using warm and air cells of claim 1, wherein the heat generation module is configured to internally contact a body skin.

* * * * *